United States Patent [19]

Bochan

[11] 4,132,009

[45] Jan. 2, 1979

[54] START SYSTEM FOR DOMESTIC APPLIANCE

[75] Inventor: John Bochan, Louisville, Ky.

[73] Assignee: General Electric Company, Louisville, Ky.

[21] Appl. No.: 801,178

[22] Filed: May 27, 1977

[51] Int. Cl.[2] ..... F26B 11/04

[52] U.S. Cl. ..... 34/45; 34/55; 34/133; 200/61.64

[58] Field of Search ..... 200/61.62, 61.64; 34/133, 45, 55; 49/498, 379

[56] References Cited

U.S. PATENT DOCUMENTS

| | | | |
|---|---|---|---|
| 2,180,886 | 11/1939 | Thomas | 49/489 |
| 2,858,619 | 11/1958 | Hughes | 34/45 |
| 3,857,002 | 12/1974 | Lay et al. | 200/61.64 |

*Primary Examiner*—John J. Camby
*Assistant Examiner*—Larry I. Schwartz
*Attorney, Agent, or Firm*—Bruce A. Yungman

[57] ABSTRACT

An improved safety start system for use in a domestic appliance. The system includes a drive motor circuit for energizing the drive motor through the drive motor switch and door switch and includes a manually operable start switch connected for energizing both the start and run windings to initiate motor operation. A switch is provided for de-energizing the start winding and locking in the run winding when the motor comes up to speed. The improvement comprises an electrically operated door latch in parallel circuit with the drive motor run winding and is actuated to lock the door closed when the run winding is energized and unlock the door when the run winding is de-energized. An arrangement is also provided to automatically open the door when it is unlocked. By this system for the appliance to operate the door must be manually closed while the start switch is operated.

6 Claims, 3 Drawing Figures

START SYSTEM FOR DOMESTIC APPLIANCE

BACKGROUND OF THE INVENTION

1. Field of the Invention

The present invention relates to a safety-start system for an appliance and more particularly, to a clothes dryer making use of such a safety-start system for preventing operation of the dryer unless the safety-start system is intentionally actuated.

2. Description of the Prior Art

Safety dictates that certain domestic appliances be provided with means for preventing the operation of the appliances unless and until the access door associated therewith is in its closed position and a definite step is taken, independent of the closing of the access door, to set the appliance into operation. Generally such a device includes a switch which must be manually actuated upon the closing of the access door of the appliance and usually it is located in a position remote from the door such as on the control panel of the appliance.

The prior art, such as in U.S. Pat. Nos. 2,135,685-Wells; 2,157,112-Bonner; 2,284,026-Stockham; 2,291,088-Morgenstern; and 3,609,265-Garbe et al; disclose safety-start devices for appliances which generally require some sort of rotational movement of a handle or knob on the door to effect actuation thereof to set the appliance in operation.

U.S. Pat. No. 3,133,168-Jacobson, assigned to the same assignee as the present invention, shows safety-start apparatus for a domestic appliance wherein rotation of a handle effects locking of a door and at the same time actuation of a switch for setting the appliance into operation. To open the access door the handle must be again rotated. U.S. Pat. No. 3,602,662-Haller discloses a safety-start device wherein manual depression of a push button, with the access door in the closed position, causes longitudinal positioning of a cam mechanism for effecting actuation of a switch member, the plunger of which moves at right angles to the motion of the push-button actuated cam mechanism. U.S. Pat. No. 3,742,162-Wasemann discloses a safety-start device for a laundry appliance wherein the closing of an access door causes the biasing of switch contact in a direction to close them while a blocking member internal to the switch housing prevents the contacts from closing until removed through manually depressing a pin extending through the housing of the laundry appliance. U.S. Pat. No. 3,924,085-Stone, assigned to the same assignee as the present invention, discloses a switch in axial alignment with a manually operated actuating member secured to the access door such that the operational components of the appliance are prevented from operation until actuated by the intentional manual operation of the actuating member. U.S. Pat. No. 3,803,725-Takeyama shows a push button mechanism for starting a clothes dryer.

U.S. Pat. No. 2,858,619-Hughes, assigned to the same assignee as the present invention, discloses a control system for a clothes dryer. Shown therein is a schematic representation of a control circuit including a push-to-start safety switch located on the control panel of the dryer. Included is a door switch operated by the door and a speed-responsive switch operated by the drive motor, the drive motor being arranged in series circuit with the door switch. Once the door is closed, the door switch is also closed and the machine may be made operational by depressing the push-to-start button, and upon the motor coming up to speed, the speed-responsive switch therin is coupled in circuit to bypass the push-to-start button. In other words the push-to-start button is depressed long enough such that the motor will come up to speed to allow the speed-responsive switch to close.

It is desirable to provide a safety-start system for an appliance, such as a domestic clother dryer, that requires supplemental manual effort to actuate after closing of the appliance door, and further in which the door automatically unlatches and the operation of the appliance is terminated upon any circuit interruption and the appliance cannot be restarted without proceeding again through the supplemental manual effort.

By the present invention, there is provided an improved safety-start system useful in an appliance, such as a domestic clothes dryer which is rather simple of construction, highly reliable, efficient, low cost, and easily adapted to any appliance cabinet having a door hinged thereto. The safety-start system of this invention causes, upon actuation, the door to be latched and maintain the appliance in operation and, unlatched upon any circuit interruption such that the door is automatically opened and shut-down of the appliance is effective.

SUMMARY OF THE INVENTION

In accordance with the present invention, there is provided in a domestic appliance an improved safety-start system. The domestic appliance has a clothes tumbling means with an opening, a drive motor for driving the tumbling means, the drive motor having a start winding and a run winding, and a cabinet enclosing the tumbling means and the drive motor. The cabinet includes a hinged door for access to the tumbling means opening. There is a control system for energizing the drive motor from a power supply, including a control mechanism having a drive motor switch, a door switch operated by the door, said door switch being open when the door is open and closed when the door is closed. Included also is a drive motor circuit for energizing the drive motor through the drive motor switch and the door switch, the circuit including a manually operable start switch connected for energizing both the start and run windings to initiate motor operation and switch means for de-energizing the start winding and locking in the run winding when the motor comes up to speed. The switch means is arranged to lock out the drive motor upon the subsequent opening of the door switch whereby said start switch must be again operated to restart the motor. The improvement comprises an electrically operated door latch in parallel circuit with the drive motor run winding and is actuated to lock the door closed when the run winding is energized and unlock the door when the run winding is de-energized. Means are also provided to automatically open the door when the door is unlocked. By this arrangement two deliberate manual actions must be taken by the operator of the appliance simultaneously to initiate operation of the appliance. That is, the door must be manually closed while the start switch is operated. This is true every time there is a circuit interruption so that the appliance cannot be restarted without proceeding again through both deliberate manual actions.

DESCRIPTION OF THE PREFERRED EMBODIMENT

Figure 1:
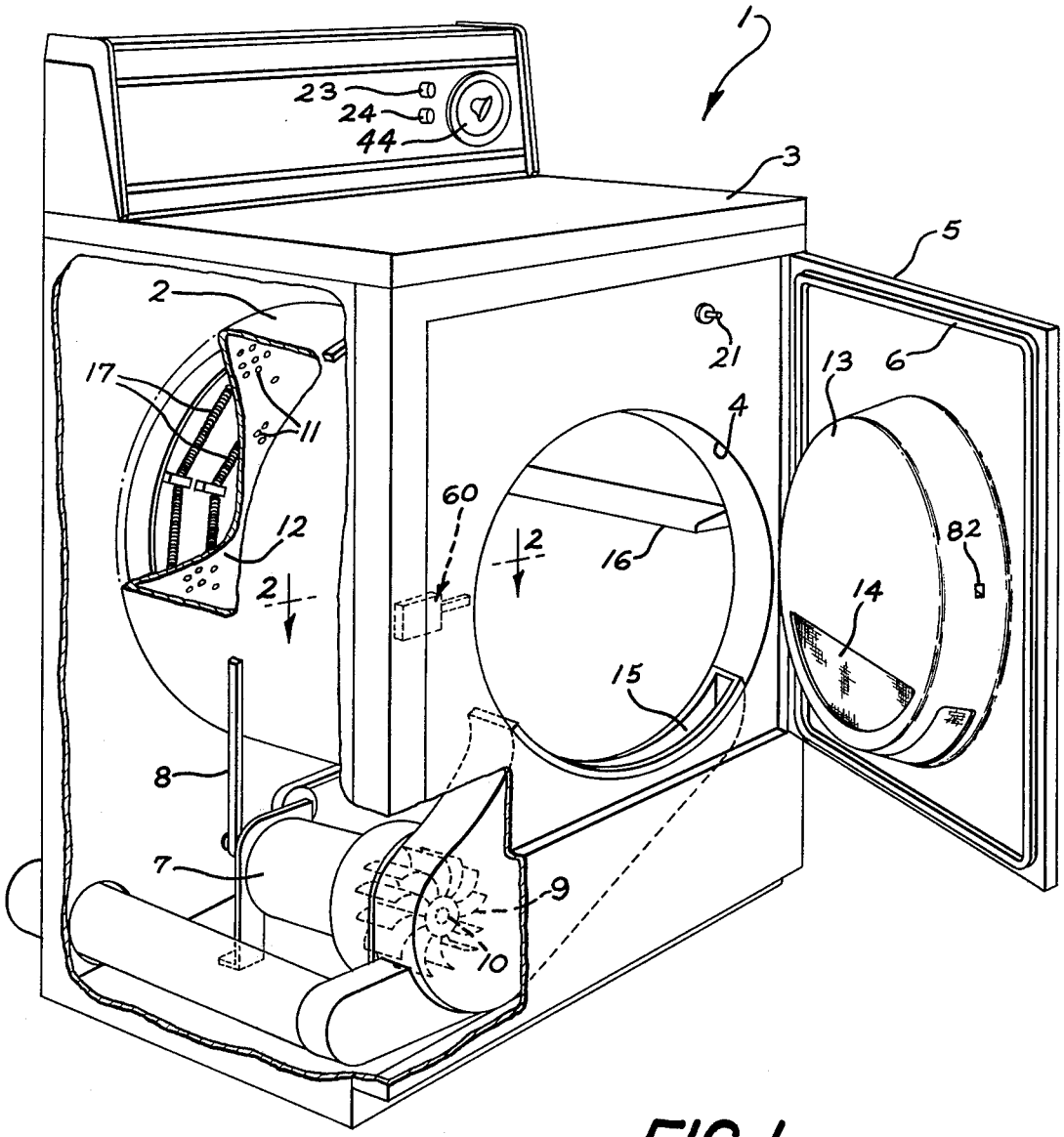
FIG. 1 is a perspective view of a domestic appliance, such as a clothes dryer, incorporating the safety start system of the present invention.

Referring now to FIG. 1 there is shown a clothes dryer 1 which is illustrative of the domestic appliances in which the improved safety-start system may be used. The dryer 1 includes a rotatable drum 2 which is mounted for rotation about a generally horizontal axis. The drum 2 is disposed within an outer enclosing cabinet structure 3, and there is an opening 4 provided for access to the interior of the drum 2. The opening 4 is for loading and unloading clothes into the drum 2. A door 5 is hingedly mounted on the cabinet and closes the opening 4 during operation of the machine. The inside of the door carries a sealing gasket 6 which surrounds the opening 4 when the door is in the closed position.

For rotation of the drum 2 during the operation of the clothes dryer there is provided an electric motor 7 which is connected to the drum 2 by a suitable drive belt 8. The pulleys (not shown) mounting the belt are so arranged that the drum 2 is driven at a suitable speed for tumbling articles of clothes therein. The drum 2 preferably includes upstanding ribs 16 on the upper surface thereof to aid in producing the tumbling action. Besides driving the drum 2, the motor 7 also serves to drive air moving means for circulating a stream of air through the drum during operation of the dryer. The air moving means comprises a blower 9 which is driven by motor 7 by means of a direct coupling 10. The blower 9 produces an air flow which causes air to be passed over the heaters 17 through perforations 11 in the rear wall 12 of the drum 2 and through the interior of the drum. The air exits the drum through a bulkhead 13 on the inside of door 5 via opening 14 therein and downwardly through a lint trap 15 and then is expelled from the machine through a venting system. By my invention there is provided an improved safety start system in such a machine and includes an electrically operated door latch 60 which locks the door closed when the machine is operating, unlocks the door when the machine is not operating and the door automatically opens when it is unlocked.

Figure 2:
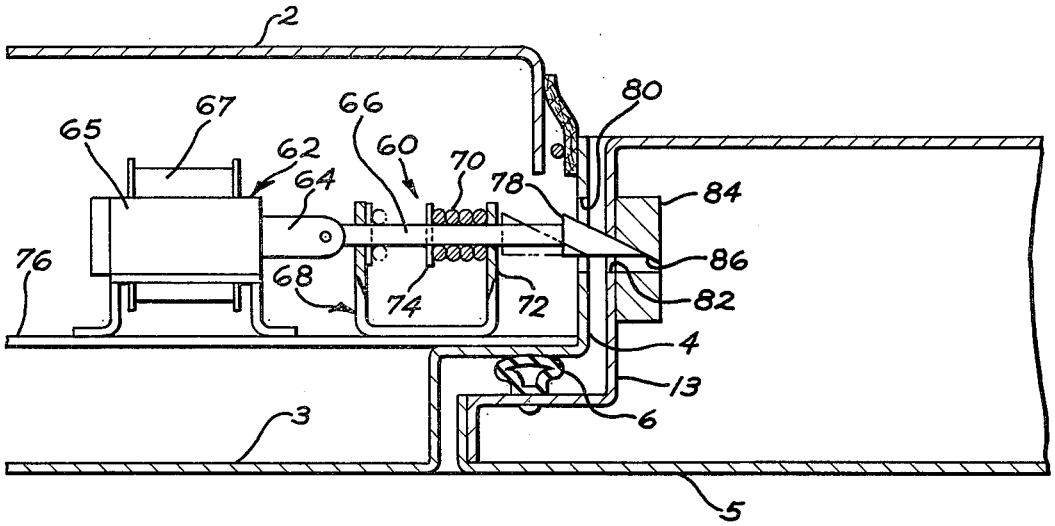
FIG. 2 is a cross sectional view of the door latch arrangement of the present safety start system invention taken along line 2—2 of FIG. 1.

With reference to FIG. 2, the door latch 60 structural arrangement will be described. The door latch 60 includes a T-type solenoid 62 that has a plunger 64 movable back and forth within the solenoid body 65 housing an electrically energized coil 67 which produces a magnetic field within the coil such that upon actuation of the solenoid the plunger moves in a direction away from the solenoid. Attached to the plunger 64 is a door latch element 66 which is movable through a U-shaped bracket 68 such that the door latch element 66 is movable back and forth relative to the U-shaped bracket 68. A spring 70 is located around the door latch element 66 with one end thereof abutting leg 72 of the U-shaped bracket 68 and the opposite end abutting a spring retainer element 74 which is secured to the door latch element 66. By this spring arrangement the door latch element 66 is biased in a direction toward the solenoid 62. Both the solenoid 62 and the U-shaped bracket 68 are stationary and may be secured by any suitable means to a bracket 76 within the cabinet 3 which is located between the cabinet 3 and the drum 2.

The door latch element 66 has at its end opposite from the solenoid 62 a wedge-shaped element 78 which is movable in unison with the door latch element 66 and passes back and forth through an opening 80 in the cabinet 3. The wedge-shaped element 78 is dimensioned to be received in an opening 82 in the bulkhead 13. Behind the opening 82 is a strike plate 84 which has a wedge-shaped opening 86 complementary to the wedge shaped element 78. Thus with the door 5 in a closed position and the solenoid 62 energized to move the door latch element 66 away from the solenoid 62 toward the bulkhead 13, the wedge shaped element 78 passes through opening 80 in the cabinet 3 and enters through opening 82 in the bulkhead 13 into the wedge shaped opening 86 in the strike plate 84. This is the door lock position. It will be understood that the complementary wedge-shaped surfaces of the element 78 and the strike plate opening 86 provide a camming action therebetween to overcome the resilient gasket 6 to compress it and cause the door to be urged or forced closed. When the solenoid 62 is de-energized spring 70 causes the solenoid plunger 64 to move toward the solenoid 62 carrying with it door latch element 66 and wedge-shaped element 78 causing the latter to be withdrawn from the wedge-shaped opening 86. This is the door unlock position of the door latch 60 and is shown in dotted in FIG. 2. Upon unlocking the door 5 the compressed resilient gasket 6 will expand and automatically open the door.

Figure 3:
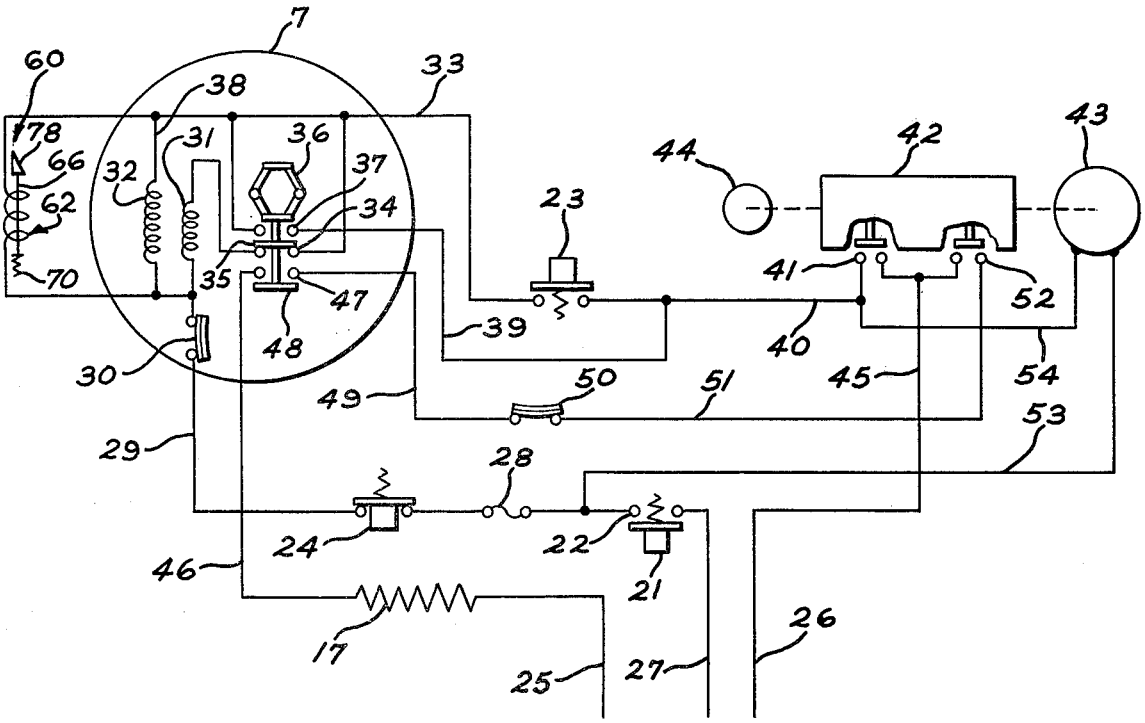
FIG. 3 is a schematic diagram of the safety-start system of my invention.

Referring now to FIG. 3, there is shown a control system for the dryer 1, this control system embodying my invention in one form thereof. This control system includes a door switch 21 whose operation is controlled by means of a door 6 of the dryer. The switch 21 includes a set of contacts 22 which are closed whenever the door is closed and which are opened whenever the door is open. These contacts 22 are so connected in the control system that they de-energize the drive means 7 whenever the door is open. The contacts, however, do not re-energize the motor circuit by themselves when the door is closed. Rather for the motor to be started again a manually operable push button start switch 23 must first be depressed. This start switch 23 which is spring biased to the normally open position is mounted on the backsplasher or control panel 24 of the dryer cabinet 3 (FIG. 1) so that it is out of reach of small children and therefore relatively safe from tampering by them.

For controlling the drive motor in this manner, the contacts 22 of the door switch and the manually operable switch 23 are both connected in the energizing of circuit for the drive motor 7. The control system as a whole is energized from a power supply comprising conductors 25 and 26 and a neutral line 27, and the drive motor circuit, specifically, is energized between the supply conductor 26 and the neutral line 27. The illustrated control system is particularly intended for use with a voltage of 220 volts between the supply conductor 25 and 26 and a voltage 110 volts between each of the supply conductors and the neutral line 27, whereby the drive motor circuit will be energized by a voltage of 110 volts. It will be understood, however, that my invention is not necessarily limited to control systems for use with a 220 volt three wire supply, but rather may be applied to control systems for use with any available domestic power supply, for example, a 110 volt two-wire supply.

Commencing with the neutral line 27 the drive motor circuit extends through the contacts 22 of the door switch, a fusible link 28, a conductor 29 and a thermal type overload protector 30 to the start and run windings 31 and 32, respectively, or the motor 7. In parallel circuit with the run winding 32 is the electrically operated door latch 60. The start and run windings are in turn both connected to a line 33 which leads to the normally open start switch 23, the run winding 32 being directly connected to the line 33 and start winding 31 being connected thereto through a set of normally closed contacts 34 of a motor speed responsive switch 35. The contacts 34 are closed so long as the motor 7 is at rest but when the motor comes up to speed switch means, which in the case of the preferred embodiment is a speed responsive switch, is operated by centrifugal mechanism 36 so as to open the contacts 34 and close a normally open set of contacts 37. It will be noted that the contacts 37 of the speed responsive or centrifugal switch 35 are connected in parallel across the start switch 23 by means of conductors 38 and 39. The purpose of this parallel connection is explained hereinafter.

From the manually operable switch 23 the motor circuit continues through a line 40 to a switch 41 of a sequence control mechanism 42. This sequence control mechanism 42 is driven by means of a timer motor 43 and includes suitable actuating means such as a cam for opening and closing the switch 41. The switch 41 is closed by the timer mechanism whenever the machine is in operation, and in fact, the operation of the dryer is terminated when the mechanism does open the switch 41. The timer mechanism may be suitably adjusted by means of a manual control knob 44 to provide the desired time of operation. No particular timer mechanism is illustrated since such mechanisms are well known to the art and any suitable one may be used. From the switch 41 the drive motor circuit is complete to power line 26 through a conductor 45.

In order to energize the drive motor 7 and door latch 60 through this circuit and thereby place the dryer in operation, the control knob 44 is first rotated so as to close the switch 41 of the timer mechanism. Assuming the door 6 to be held closed so that the contacts 22 of the door switch are closed, the circuit is then ready for energizing the drive motor 7 and the door latch 60. To complete the circuit and energize the drive motor 7 and door latch 60 it is then necessary to close the manual push button switch 23. The closing of the switch 23 energizes both the start and run windings of the drive motor and the solenoid 62 of the door latch 60 to lock the door closed, the run winding and solenoid 62 being energized directly between the motor protector 30 and the line 33 and the start winding being energized between the motor protector and the line 33 through the contacts 34 of the motor centrifugal switch 35. As soon as the motor comes up to speed, the contacts 34 of the centrifugal switch are opened, de-energizing the start winding. Simultaneously the contacts 37 of the switch are closed, and the closing of the contacts 37 shorts out the start switch 23 through the conductors 38 and 39. This locks in the motor and the door latch 60 and the start switch 23 may thereupon be released. In other words the run winding 32 of the motor and the solenoid 62 are now energized through the contacts 37 and the lines 38 and 39 so that it will continue the motor in operation and the door latch 60 in the locked position without the start switch being closed.

The energization of the drive motor 7 and door latch 60 through the contacts 37 continues until such time as either the door switch or the timer operated switch 41 is opened. The opening of either of these switches, of course, breaks the motor circuit and de-energizes the motor 7 and the door latch 60. The motor being de-energized thereupon comes to a stop, opening the contacts 37 of the centrifugal switch 35 and closing the contacts 34. The door latch 60 upon being de-energized is caused by spring 70 to be unlocked as heretofore explained in connection with FIG. 2. Upon unlocking the compressed resilient gasket 6 will cause the door 5 to pop open automatically. Other means including spring biasing the door may be employed to automatically open the door when the door is unlocked.

The opening of the contacts 37, in accordance with my invention, breaks the drive motor circuit at a second point and thereby locks out the drive motor 7 and the door latch 60 even if the timer operated switch 41 or the door switch 21 should be immediately reclosed. The only way that the drive motor and door latch can be re-energized once either of these switches is opened is for the door to be held closed compressing the door gasket 6 and the manually operated switch 23 to be closed. The closing of the switch 23, as explained above, shorts out the contacts 37 and thereby completes again the drive motor circuit to place the drive motor back in operation and the solenoid 62 energized to lock the door closed. Once the motor comes up to speed, the contacts 37 are closed once more by the centrifugal mechanism and the manual switch may be released.

If it is desired that the door be opened during the cycle there may, as shown in the preferred embodiment, be a push button, normally closed, interrupt switch 24. This switch 24 preferably is located remote from the door 5 and may also be on the control panel. By the machine operator actuating interrupt switch 24 the circuit to the drive motor 7 is opened and the solenoid 62 de-energized thus unlocking the door whereupon it pops open automatically and the drive motor 7 operation terminated.

The arrangement of the manually operated switch 23 is particularly intended to prevent accidental restarting of the dryer when the operator opens the dryer door as by operating interrupt switch 24 during the cycle in order to check the condition of the clothes. The operator may open the door 6 during the cycle in order to feel the clothes and see if they are sufficiently dry to be removed from the machine. Then if the operator decides that the clothes have dried sufficiently, he or she will normally remove them from the machine, leaving the door open. In this case since the timer has not yet opened switch 41, the drive motor circuit is still conditioned for operation. Since the manually operated switch 23 must be closed in addition to simultaneously holding the door closed so that the door switch is closed, any accidental starting of the dryer is completely avoided. Thus clothes may safely be removed from the dryer at any point during the drying operation without turning the timer to the "off" position.

When the machine 1 is acting as a clothes dryer the heater 17 is energized concurrently with the drive motor. The heater 17 specifically is energized across the power supply conductors 25 and 26. Commencing with the conductor 25, the heater circuit extends through the heater itself and a conductor 46 to the normally open contacts 47 of a second motor operated, speed responsive switch 48. Preferably and as shown this switch 48 is operated by the same centrifugal mechanism 36 as the switch 35. From the contacts 47 the heater circuit continues through a line 49, a heater cycling thermostat 50, and a line 51 to a switch 52 of the sequence control mechanism 42. This switch 52 like the switch 41 is controlled by means of a cam operated by the timer motor 43. From the switch 52 the heater circuit is completed through the line 45 to the power supply conductor 26. Energized through this circuit it will be seen that the heater 17 will be energized so long as the centrifugal switch 48 and the timer operated switch 52 are closed. If either of the switches are opened, the heater will be de-energized. The heater cycling thermostat 50 also is effective to de-energize the heater whenever the temperature within the dryer rises above a certain predetermined suitable level for drying clothes. The cycling thermostat 50 may be positioned at any suitable place within the dryer but preferably if is positioned near the top of the dryer in the path of the air after it leaves the heater and before it enters the tumbling drum.

The timer mechanism 42 is preferably so arranged that it includes two separate operating ranges for the dryer, these ranges being separated by "off" positions. In one of these ranges both switches 41 and 52 are closed so that both the drive motor and the heater are energized. This of course results in a clothes drying operation. In the second of these ranges however only the drive motor switch 41 is closed. This results in a clothes tumbling operation without heat. This operation may be used to fluff previously dried clothes.

Assuming that the timer mechanism 42 is adjusted by the means of the knob 44 so that both switches 41 and 52 are closed, the heater circuit will then be energized concurrently with the drive motor circuit. However the heater circuit is not energized immediately as soon as the manually operated switch 23 is depressed to start the dryer. Rather the heater circuit is not closed until such time as the centrifugal switch mechanism closes the contacts 37 and 47. In other words the heater circuit is not completed until the centrifugal switch mechanism locks in the drive motor circuit. Once the heater circuit is closed by the centrifugal switch 48, it then remains closed under the control of the cycling thermostat 50 until either the sequence control switch 52 or the centrifugal switch contacts 47 are opened. Normally unless the door 6 is opened, the centrifugal switch contacts 47 will remain closed throughout the drying operation until the timer mechanism opens the switch 52. The switch 52 is preferably opened a short time prior to the opening of the switch 41 to provide a machine cool-down period during which cool air is blown through the dryer to cool both the clothes and the machine itself down to a suitable temperature for the removal of the clothes.

If, however, the door 6 should be opened, as by opening interrupter switch 24, then the heater circuit will be de-energized by the centrifugal switch 48. The opening of the door, of course, de-energizes the drive motor in the manner described above and as the drive motor comes to a stop, the contacts 47 are opened. The opening of the contacts 47 breaks the heater circuit and thereby prevents any heating of the machine and the clothes until such time as the drive motor is placed back in operation. In other words due to the action of the centrifugal switch 48, the heater is locked out just like the drive motor and door latch until such time as the door 6 is reclosed and the manual switch 23 is depressed.

When the timer has run during the drying operation for the length of time preselected by the operator, it then opens the switches 41 and 52 to terminate the operation of the machine, the switch 52 being opened slightly before the switch 41 to provide the machine cool-down period mentioned above. During the clothes tumbling operation without heat, the switch 52 is of course never closed so that in that operation the timer merely opens the switch 41 to terminate the operation.

The timer motor 43 like the drive motor 7 and door latch 60 is energized between the neutral line 27 and the supply conductor 26. Starting with the neutral line 27 the timer motor circuit extends through the contacts 22 of the door switch 21 and a line 53 to the timer motor itself. From the other side of the timer motor the circuit passes through a line 54 to the switch 41 of the timer and from there it is completed to the supply conductor 26 through the line 45. Energized through this circuit it will be seen that the timer motor is energized whenever the door switch 21 and the timer switch 41 are closed. When the timer switch 41 opens at the end of the machine operation, the timer motor is de-energized at the same time as the drive motor.

From the above it will be seen that I have provided a new and improved control system for a clothes dryer, in which the door must be manually held closed while a start button is depressed in order to place the machine in operation. If the door of the dryer should be unlocked during the drying operation, the door automatically opens and a door switch interrupts the operation of the dryer. However, the mere closing of the door does not start the dryer up again nor merely actuating the start button. Rather the start button must be depressed while the door is being held closed in order to place the dryer back in operation. The start button must also be depressed while the door is held closed at the beginning of the dryer operation to start the dryer operation in the first place. In my preferred arrangement the motor speed responsive or centrifugal switch automatically locks in the motor circuit after the start button has depressed and then automatically locks out the circuit whenever it is de-energized by any other means such as the door switch. In may preferred embodiment the centrifugal switch and the start switch are, of course, connected in electrical parallel to effect that result. It will be understood that while the preferred embodiment of the invention utilizes a speed responsive or centrifugal switch other switch means, such as a relay, may be used.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. In a domestic appliance having clothes tumbling means with an opening to receive the clothes, a drive motor for driving the tumbling means, said drive motor having a start winding and a run winding, and a cabinet enclosing the tumbling means and the drive motor and including a door for access to the tumbling means opening, a control system for energizing the drive motor from a power supply, including a control mechanism having a drive motor switch, a door switch operated by the door, said door switch being open when the door is open and closed when the door is closed, a drive motor circuit for energizing the drive motor through the drive motor switch and the door switch, the circuit including a manually operable start switch connected for energizing both the start and run windings to initiate motor operation and switch means for de-energizing the start winding and locking in the run winding when the motor comes up to speed, the switch means being arranged to lock out the drive motor upon the subsequent opening of the door switch, whereby said start switch must be again operated to restart the motor, the improvement comprising an electrically operated door latch means in parallel circuit with the drive motor run winding and resilient means interposed between the door and the cabinet for biasing said door toward its open position, said door latch means being arranged to urge the door to its closed position against the bias of said resilient means and to lock the door in its closed position when the run winding is energized and to unlock the door when the run winding is de-energized, said resilient means automatically urging said door toward its open position when the door is unlocked, so that when starting the appliance said door must be held closed manually to overcome said resilient means and simultaneously said start switch must be closed to simultaneously actuate the door latch means and energize the motor run winding.

2. In the clothes dryer of claim 1 wherein there is a normally closed manually operable interrupt switch in series circuit with the door switch for de-energizing the motor windings and the door latch means upon opening.

3. In the clothes dryer of claim 2 wherein the normally closed manually operable interrupt switch is a push button switch located remote from the door.

4. In the domestic appliance of claim 1 wherein the electrically operated door latch means comprises a solenoid mounted on the cabinet near the tumbling means opening, said solenoid having a plunger movably mounted therein, a door latch element attached at one end to the plunger, a wedge-shaped element mounted to the end of the door latch element opposite the plunger, a strike plate having a wedge-shaped opening mounted on the door for engagement by said wedge-shaped element when the solenoid is activated, said engagement providing a camming action between the wedge-shaped element and the strike plate which urges the door closed and locks it closed, and means for urging said wedge-shaped element out of said engagement with said strike plate when said solenoid is de-activated.

5. In the domestic appliance of claim 4 wherein the means for urging said wedge-shaped element out of engagement with said strike plate is a spring.

6. In the domestic appliance of claim 1 wherein the resilient means to open the door is a sealing gasket surrounding the opening to the tumbling means.

* * * * *